US010064462B2

(12) United States Patent
Pao

(10) Patent No.: US 10,064,462 B2
(45) Date of Patent: Sep. 4, 2018

(54) ROPE GUIDING DEVICE AND WALKING STICK CHAIR HAVING THE SAME

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 216 days.

(21) Appl. No.: 15/271,449

(22) Filed: Sep. 21, 2016

(65) Prior Publication Data

US 2017/0086542 A1 Mar. 30, 2017

(30) Foreign Application Priority Data

Sep. 24, 2015 (TW) ..... 104131547 A

(51) Int. Cl.

| | |
|---|---|
| ***A45B 5/00*** | (2006.01) |
| ***A47C 4/04*** | (2006.01) |
| ***A47C 13/00*** | (2006.01) |
| ***A47C 9/10*** | (2006.01) |
| *A45B 25/22* | (2006.01) |

(52) U.S. Cl.

CPC ..... *A45B 5/00* (2013.01); *A47C 4/04* (2013.01); *A47C 9/105* (2013.01); *A47C 13/00* (2013.01); *A45B 25/22* (2013.01); *A45B 2200/1009* (2013.01)

(58) Field of Classification Search

CPC ... A45B 5/00; A45B 25/22; A45B 2200/1009; A47C 4/04; A47C 9/105; A47C 13/00

USPC ..... 135/66, 146; 297/16.2

See application file for complete search history.

(56) References Cited

U.S. PATENT DOCUMENTS

| | | | | |
|---|---|---|---|---|
| 410,021 A * | 8/1889 | Purington | ..... | A45B 5/00 248/155.4 |
| 436,176 A * | 9/1890 | Hendrickson | ..... | A45B 5/00 248/155.3 |
| 771,165 A * | 9/1904 | Manderson | ..... | A45B 5/00 135/66 |

(Continued)

FOREIGN PATENT DOCUMENTS

| | | |
|---|---|---|
| CN | 2443635 Y | 8/2001 |
| CN | 103720148 A | 4/2014 |

(Continued)

OTHER PUBLICATIONS

Search Report appended to an Office Action, which was issued to Chinese counterpart application No. 201610845734.9 by the SIPO dated Nov. 27, 2017, with an English translation thereof.

*Primary Examiner* — Robert Canfield
(74) *Attorney, Agent, or Firm* — Burris Law, PLLC

(57) ABSTRACT

A rope guiding device includes a base seat, two limiting link assemblies connected to the base seat, and a limiting rope. Each of the limiting link assemblies has a retaining space therein, and a guiding groove in spatial communication with the retaining space. The limiting rope includes two head pieces respectively and movably retained in the retaining spaces of the limiting link assemblies, and a rope body having two opposite end portions that respectively extends through the guiding grooves of the limiting link assemblies and that are respectively connected to the head pieces. Each of the head pieces has a width greater than the width of each of the guiding grooves and the width of the rope body.

11 Claims, 12 Drawing Sheets

(56) References Cited

U.S. PATENT DOCUMENTS

| | | | | | |
|---|---|---|---|---|---|
| 952,335 | A * | 3/1910 | Killian | A45B 5/00 | 135/66 |
| 1,565,636 | A * | 12/1925 | Goetz | A47C 9/105 | 108/128 |
| 3,414,323 | A * | 12/1968 | Mitchum | A47C 4/20 | 248/121 |
| 4,266,748 | A * | 5/1981 | Dalton | A01M 31/02 | 108/139 |
| D282,320 | S * | 1/1986 | Anderson | D16/244 | |
| 2007/0013211 | A1* | 1/2007 | Crowell | A47C 4/02 | 297/16.2 |
| 2015/0351548 | A1* | 12/2015 | Schiraga | A47C 4/04 | 297/452.1 |

FOREIGN PATENT DOCUMENTS

| | | | | | |
|---|---|---|---|---|---|
| GB | 191007833 | A * | 9/1910 | A45B 5/00 | |
| JP | H1042986 | A | 2/1998 | | |
| JP | 2003293644 | A | 10/2003 | | |
| JP | 2005180154 | A | 7/2005 | | |
| JP | 2015131109 | A | 7/2015 | | |
| WO | WO-2016004572 | A1 * | 1/2016 | A45B 5/00 | |

* cited by examiner

ROPE GUIDING DEVICE AND WALKING STICK CHAIR HAVING THE SAME

CROSS-REFERENCE TO RELATED APPLICATION

This application claims priority of Taiwanese Patent Application No. 104131547, filed on Sep. 24, 2015.

FIELD

The disclosure relates to a reinforcing device, and more particularly to a rope guiding device for a walking stick chair.

BACKGROUND

Referring to FIGS. 1 and 2, a conventional walking stick chair 1 includes a main stick 11, an interlink unit 12, a seat unit 13 and a leg unit 14. The main stick 11 has a handle end, and a foot end opposite to the handle end. The interlink unit 12 includes first, second and third sliders 121, 122, 123 that are movable along the main stick 11 and that are arranged sequentially in a direction from the handle end to the foot end. The seat unit 13 includes a seat plate 131 that is pivotally connected to the first slider 121, and two linkage sets 132 each of which is pivotally connected to the second slider 122 and the seat plate 131. The leg unit 14 includes two first legs 141 that are pivotally connected to the second slider 122, two second legs 142 that are respectively and pivotally connected to the first legs 141, two link members 143 each of which is pivotally connected to the first slider 121 and a respective one of the first legs 141, and a two auxiliary legs 144 each of which is pivotally connected to the third slider 123 and a respective one of the second legs 142.

The conventional walking stick chair 1 is operable to convert between an unfolded state (see FIG. 1) and a folded state (see FIG. 2). When the conventional walking stick chair 1 is in the unfolded state, the second legs 142 are away from the main stick 11 and cooperatively support the main stick 11 inclinedly on a ground. When the conventional walking stick chair 1 is converted from the unfolded state to the folded state, the first and second sliders 121, 122 are moved away from each other such that the linkage sets 132 are folded to drive the seat plate 131 to pivot toward the main stick 11, and that each of the link members 143 drives the corresponding first, second and auxiliary legs 141, 142, 144 to be folded. When the conventional walking stick chair 1 is in the folded state, each of the first legs 141 and the corresponding second leg 142 are mutually folded and close to the main stick 11, and the linkage sets 132, the link members 143 and the auxiliary legs 144 are close to the main stick 11.

When the conventional walking stick chair 1 is in the unfolded state to support a user, the first legs 141 cooperatively form an angle, and there is no reinforcing structure for limiting the angle formed between the first legs 141. If the user is relatively heavy or the ground is slippery, the weight of the user may enlarge the angle formed between the first legs 141. As a result, excessive deformation or fracture at the junction of the second slider 122 and the first legs 141 may occur.

SUMMARY

Therefore, an object of the disclosure is to provide a rope guiding device that can alleviate at least one of the drawbacks of the prior art.

According to the disclosure, the rope guiding device includes a base seat, two limiting link assemblies and a limiting rope. Each of the limiting link assemblies is movably connected to the base seat, and has a retaining space therein, and a guiding groove that is formed in an outer surface thereof and that is in spatial communication with the retaining space. The limiting rope includes two head pieces that are respectively and movably retained in the retaining spaces of the limiting link assemblies, and a rope body that has two opposite end portions respectively extending through the guiding grooves of the limiting link assemblies and respectively connected to the head pieces. Each of the head pieces has a width greater than the width of each of the guiding grooves and the width of the rope body. When the limiting link assemblies are moved toward each other, the limiting link assemblies move the head pieces of the limiting rope toward each other so as to deform the rope body. During the deformation of the rope body, the end portions of the rope body respectively move along the guiding grooves of the limiting link assemblies to respectively rotate the head pieces relative to the limiting link assemblies.

Another object of the disclosure is to provide a walking stick chair that can alleviate at least one of the drawbacks of the prior art.

According to the disclosure, the walking stick chair includes a main stick, an interlink unit, a seat unit and a leg unit. The interlink unit includes a base seat that is disposed on the main stick. The seat unit is disposed on the main stick, and includes a seat plate assembly that is movable relative to the main stick. The leg unit includes two limiting link assemblies and a limiting rope. Each of the limiting link assemblies is pivotally connected to the base seat, and has a retaining space therein, and a guiding groove that is formed in an outer surface thereof and that is in spatial communication with the retaining space. The limiting rope includes two head pieces that are respectively and movably retained in the retaining spaces of the limiting link assemblies, and a rope body that has two opposite end portions respectively extending through the guiding grooves of the limiting link assemblies and respectively connected to the head pieces. Each of the head pieces has a width greater than the width of each of the guiding grooves and the width of the rope body. The walking stick chair is operable to convert between an unfolded state and a folded state. When the walking stick chair is in the unfolded state, an end of the seat plate assembly is away from the main stick, the limiting link assemblies cooperatively form an angle therebetween, and the limiting rope is stretched for limiting the angle formed between the limiting link assemblies. When the walking stick chair is converted from the unfolded state toward the folded state, the end of the seat plate assembly moves toward the main stick, and the limiting link assemblies pivot toward the main stick and move toward each other. During the movement of the limiting link assemblies toward each other, the limiting link assemblies move the head pieces of the limiting rope toward each other so as to deform the rope body. During the deformation of the rope body, the end portions of the rope body respectively move along the guiding grooves of the limiting link assemblies to respectively rotate the headpieces relative to the limiting link assemblies.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
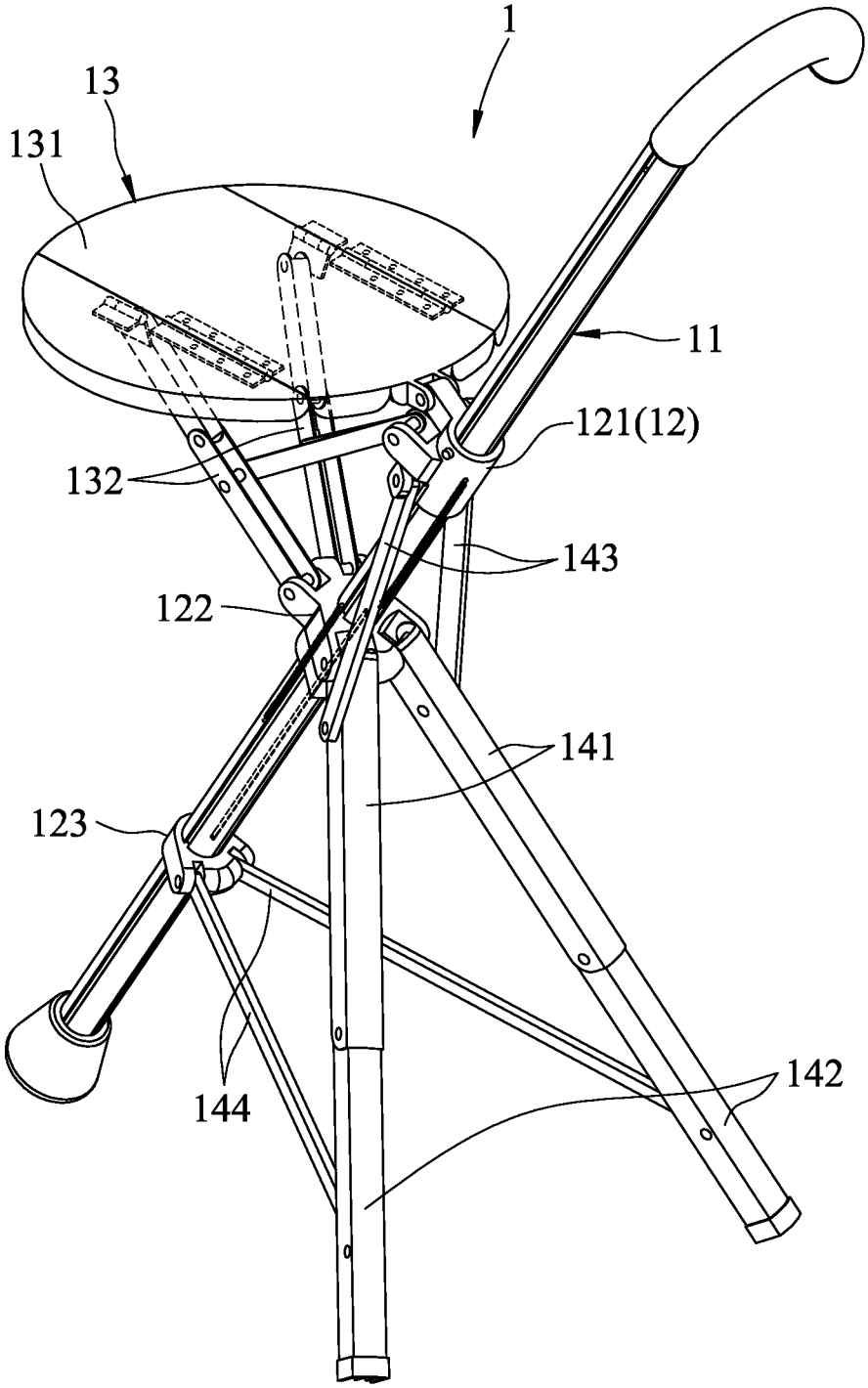
FIG.1 PRIOR ART
FIG. 1 is a schematic perspective view illustrating a conventional walking stick chair in an unfolded state.
Figure 2:
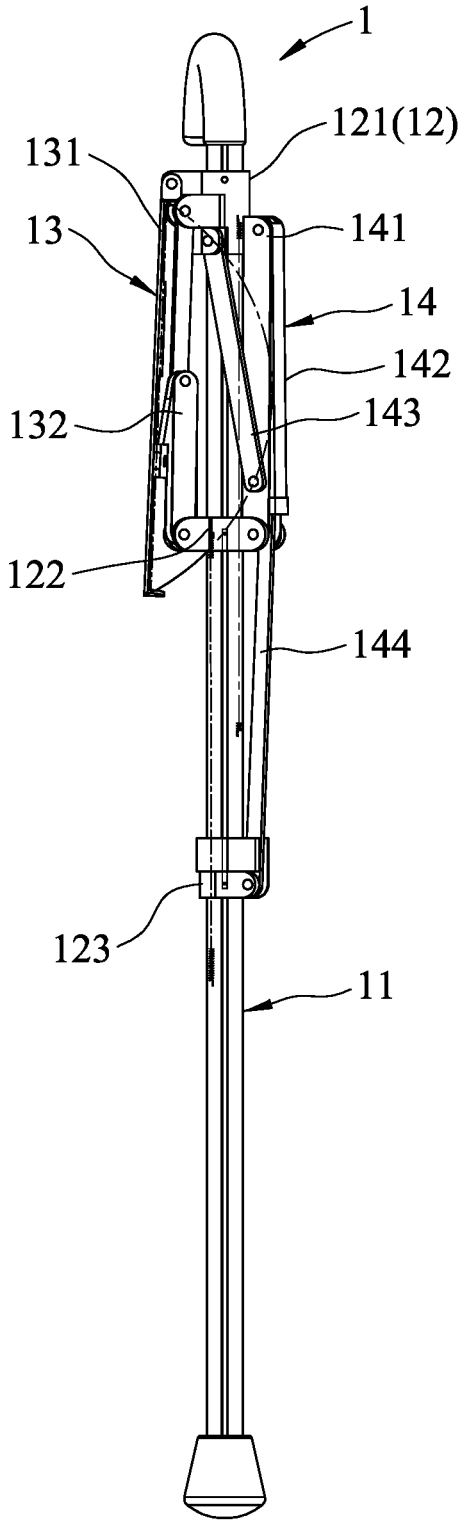
FIG.2 PRIOR ART
FIG. 2 is a side view illustrating the conventional walking stick chair in a folded state.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
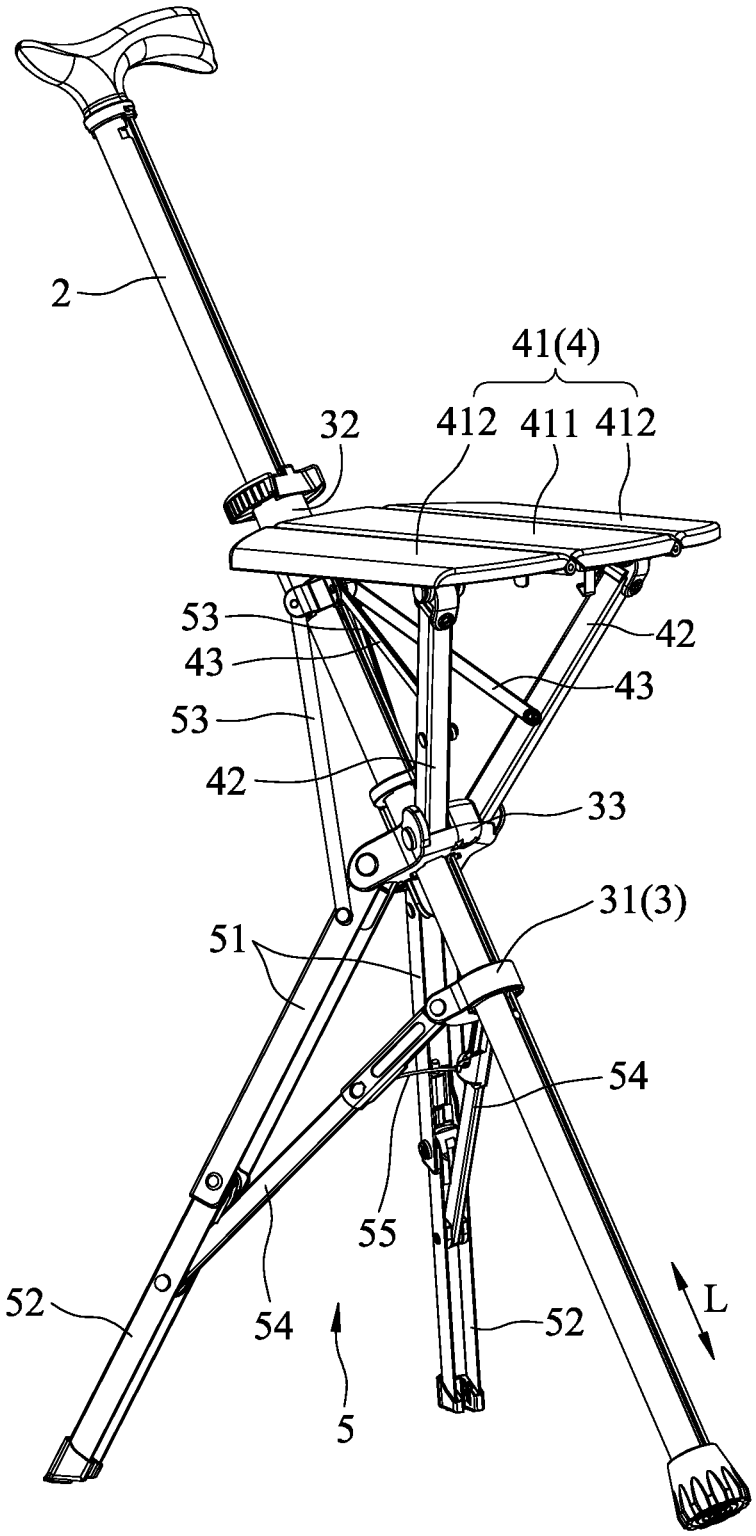
FIG. 3 is a schematic perspective view illustrating a first embodiment of the walking stick chair according to the disclosure in an unfolded state.

Referring to FIG. 3, the first embodiment of the walking stick chair according to the disclosure includes a main stick 2, an interlink unit 3, a seat unit 4 and a leg unit 5.

The main stick 2 extends in a direction (L) to terminate at a handle end and a foot end opposite to the handle end.

The interlink unit 3 includes a base seat 31 that is sleeved on and movable along the main stick 2, a first sliding seat 32 that is sleeved on and movable along the main stick 2, and that is disposed at one side of the base seat 31 opposite to the foot end of the main stick 2, and a second sliding seat 33 that is sleeved on and movable along the main stick 2, and that is disposed between the first sliding seat 32 and the base seat 31.

The seat unit 4 includes a seat plate assembly 41 that is connected to the first sliding seat 32, two first links 42 each of which has two opposite ends respectively and pivotally connected to the second sliding seat 33 and the seat plate assembly 41, and two second links 43 each of which has two opposite ends respectively and pivotally connected to the first sliding seat 32 and a respective one of the first links 42. The seat plate assembly 41 includes a main plate 411 that is pivotally connected to the first sliding seat 32, and two lateral plates 412 that are respectively and pivotally connected to two lateral sides of the main plate 411. The end of each of the first links 42 opposite to the second sliding seat 33 is pivotally connected to a respective one of the lateral plates 412 of the seat plate assembly 41.

The leg unit 5 includes two first legs 51 each of which is pivotally connected to the second sliding seat 33, two second legs 52 each of which is pivotally connected to a respective one of the first legs 51, two link members 53 each of which has two opposite ends respectively and pivotally connected to the first sliding seat 32 and a respective one of the first legs 51, two limiting link assemblies 54 each of which has two opposite ends respectively and pivotally connected to the base seat 31 and a respective one of the second legs 52, and a limiting rope 55 that is connected between the limiting link assemblies 54.

Figure 4:
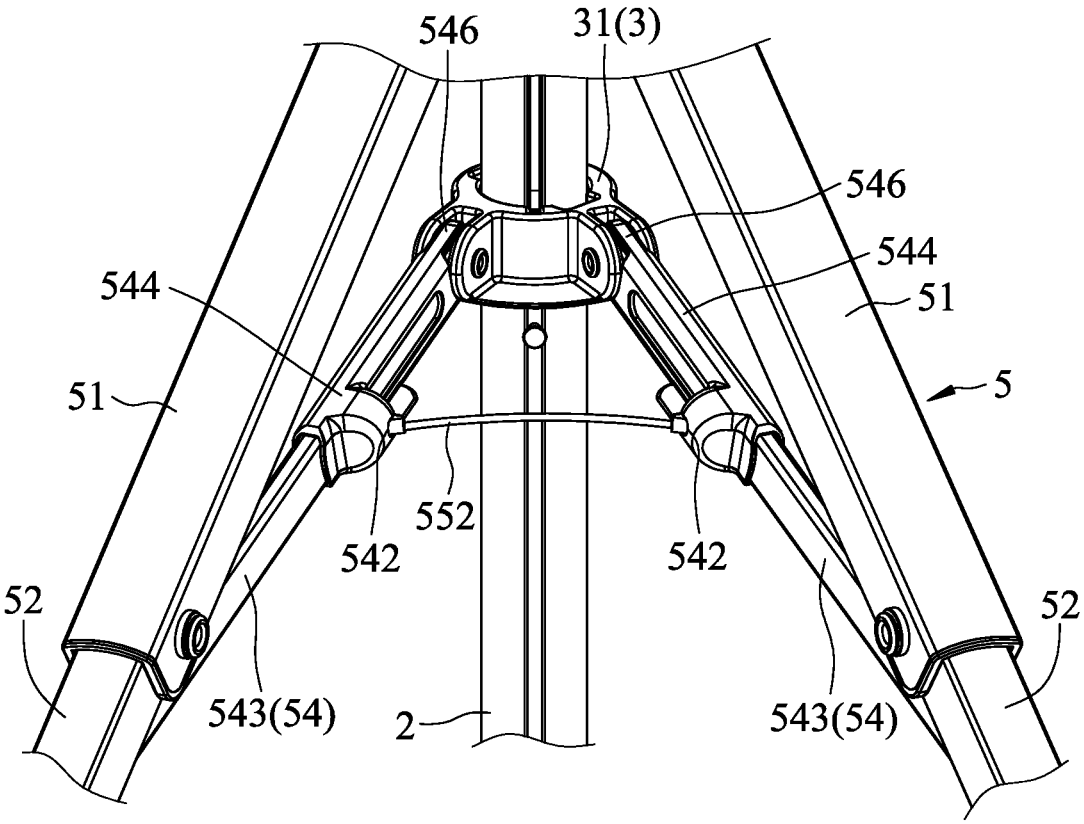
FIG. 4 is a schematic fragmentary perspective view illustrating a rope guiding device of the first embodiment.
Figure 5:
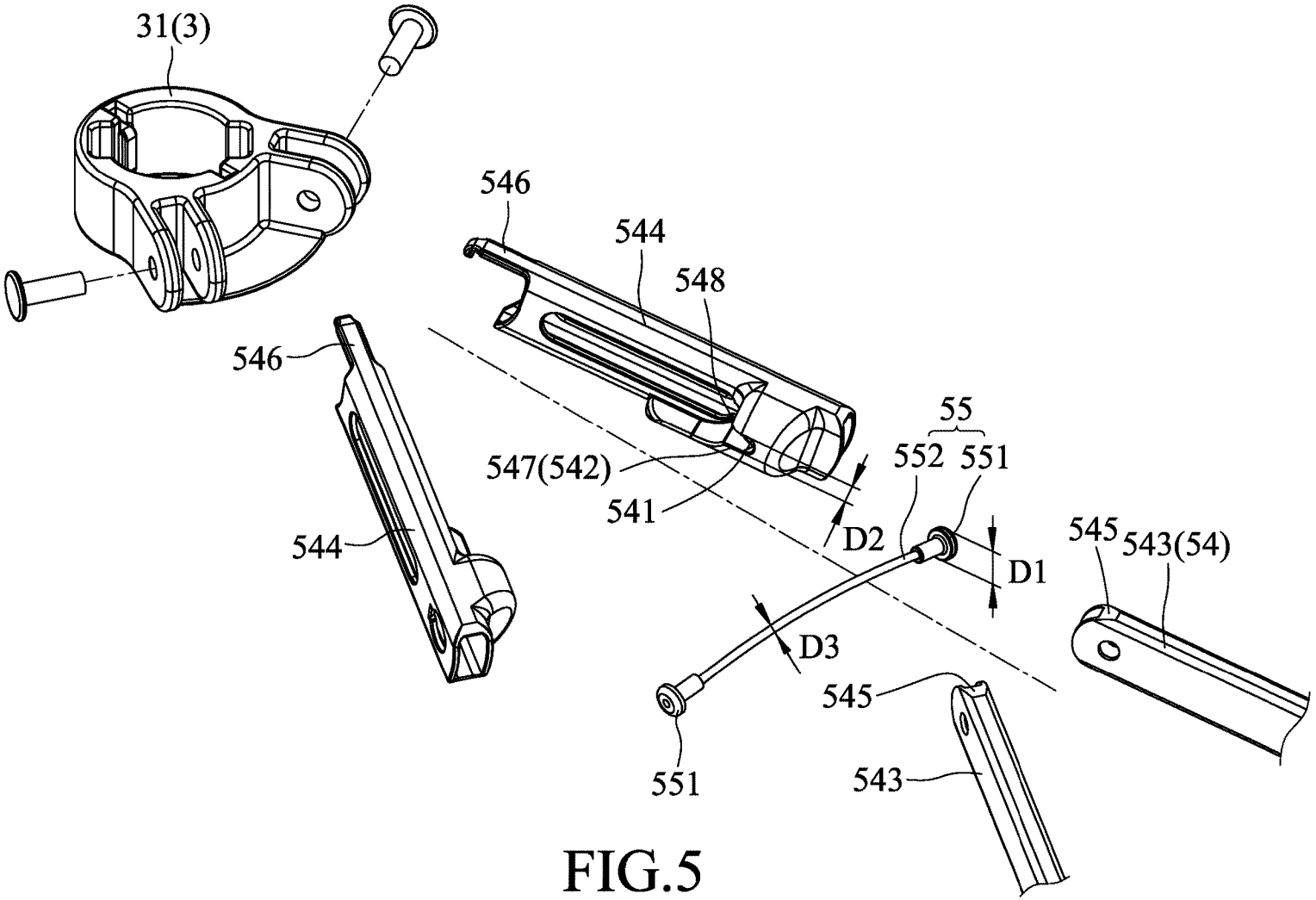
FIG. 5 is a fragmentary exploded perspective view illustrating the rope guiding device.
Figure 6:
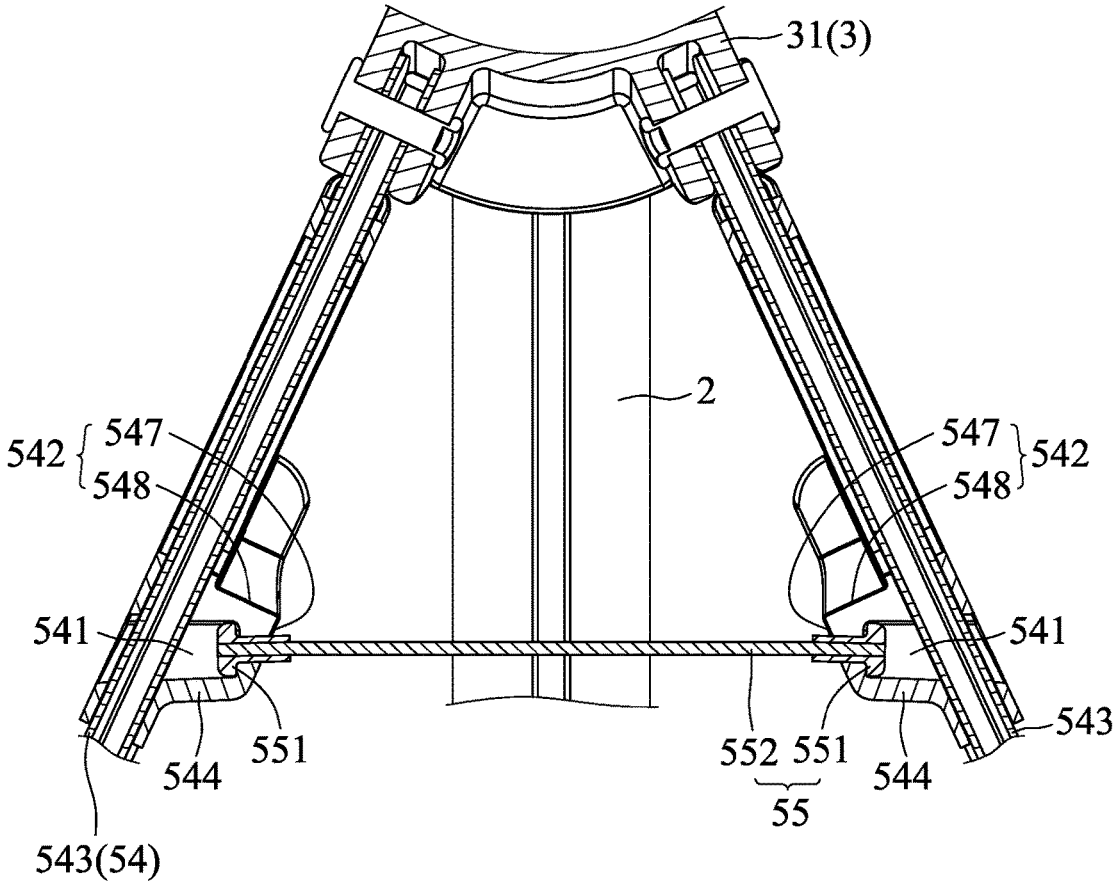
FIG. 6 is a schematic fragmentary sectional view illustrating the rope guiding device.

Referring further to FIGS. 4 to 6, each of the limiting link assemblies 54 has a retaining space 541 (see FIG. 6) formed therein, a guiding groove 542 (see FIGS. 5 and 6) formed in an outer surface thereof and being in spatial communication with the retaining space 541, a limiting link 543 having two opposite ends that are respectively and pivotally connected to the base seat 31 and the corresponding second leg 52, and a mounting seat 544 mounted to the limiting link 543 and proximate to the base seat 31. The limiting link 543 of each of the limiting link assemblies 54 has a first coupling structure 545. The mounting seat 544 of each of the limiting link assemblies 54 has an outer surface formed with the guiding groove 542 of the limiting link assembly 54, and a second coupling structure 546 proximate to the base seat 31. For each of the limiting link assemblies 54, the mounting seat 544 is fixedly mounted to the limiting link 543 by virtue of the first and second coupling structures 545, 546. In this embodiment, the second coupling structure 546 is configured as a hook. The mounting seat 544 and the limiting link 543 of each of the limiting link assemblies 54 cooperatively define the retaining space 541 of the limiting link assembly 54. The guiding groove 542 of each of the limiting link assemblies 54 has a first groove section 547 and a second groove section 548 (see FIGS. 5 and 6). The first groove sections 547 of the guiding grooves 542 of the limiting link assemblies 54 open toward each other. The second groove section 548 of the guiding grooves 542 of each of the limiting link assemblies 54 opens toward the base seat 31. In one embodiment, the mounting seat 544 of each of the limiting link assemblies 54 may be sleeved on the corresponding limiting link 543.

The limiting rope 55 includes two head pieces 551 that are respectively and movably retained in the retaining spaces 541 of the limiting link assemblies 54, and a rope body 552 that has two opposite end portions respectively extending through the guiding grooves 542 of the limiting link assemblies 54, and respectively connected to the head pieces 551. With particular reference to FIG. 5, each of the head pieces 551 has a width (D1) greater than the width (D2) of each of the guiding grooves 542 and the width (D3) of the rope body 552. In this embodiment, the rope body 552 is configured as a steel wire rope.

In this embodiment, the base seat 31, the limiting link assemblies 54 and the limiting rope 55 cooperatively serve as a rope guiding device.

Figure 7:
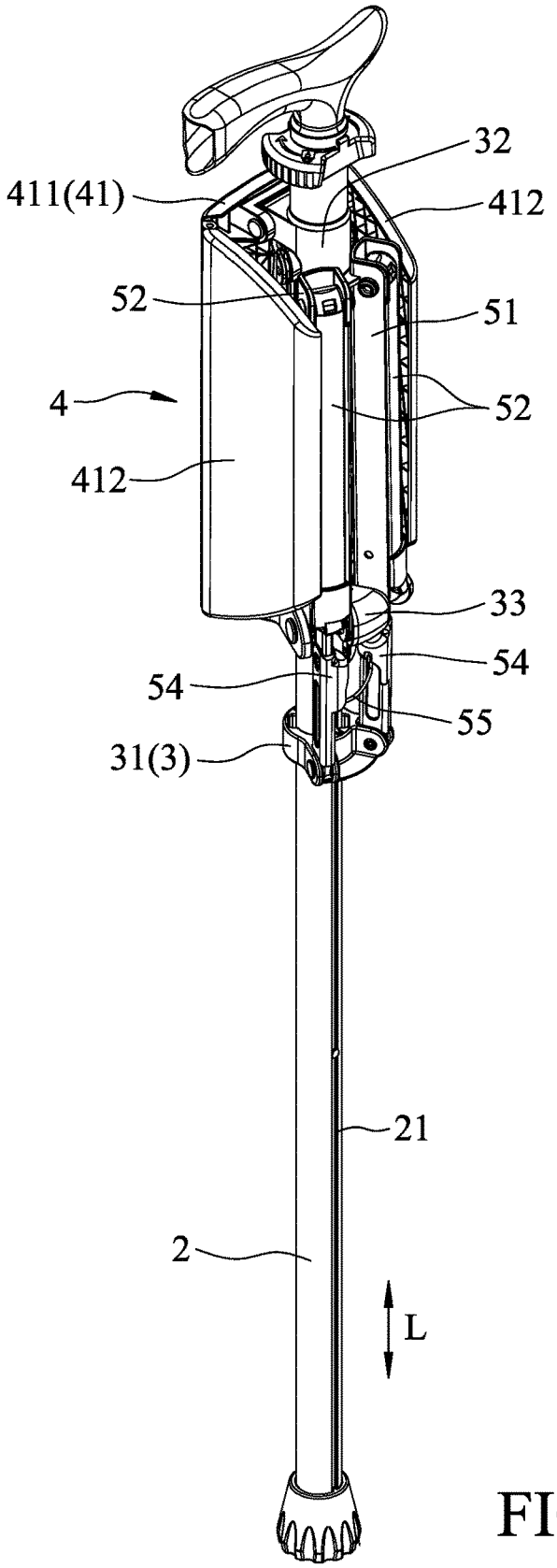
FIG. 7 is a schematic perspective view illustrating the first embodiment in a folded state.
Figure 8:
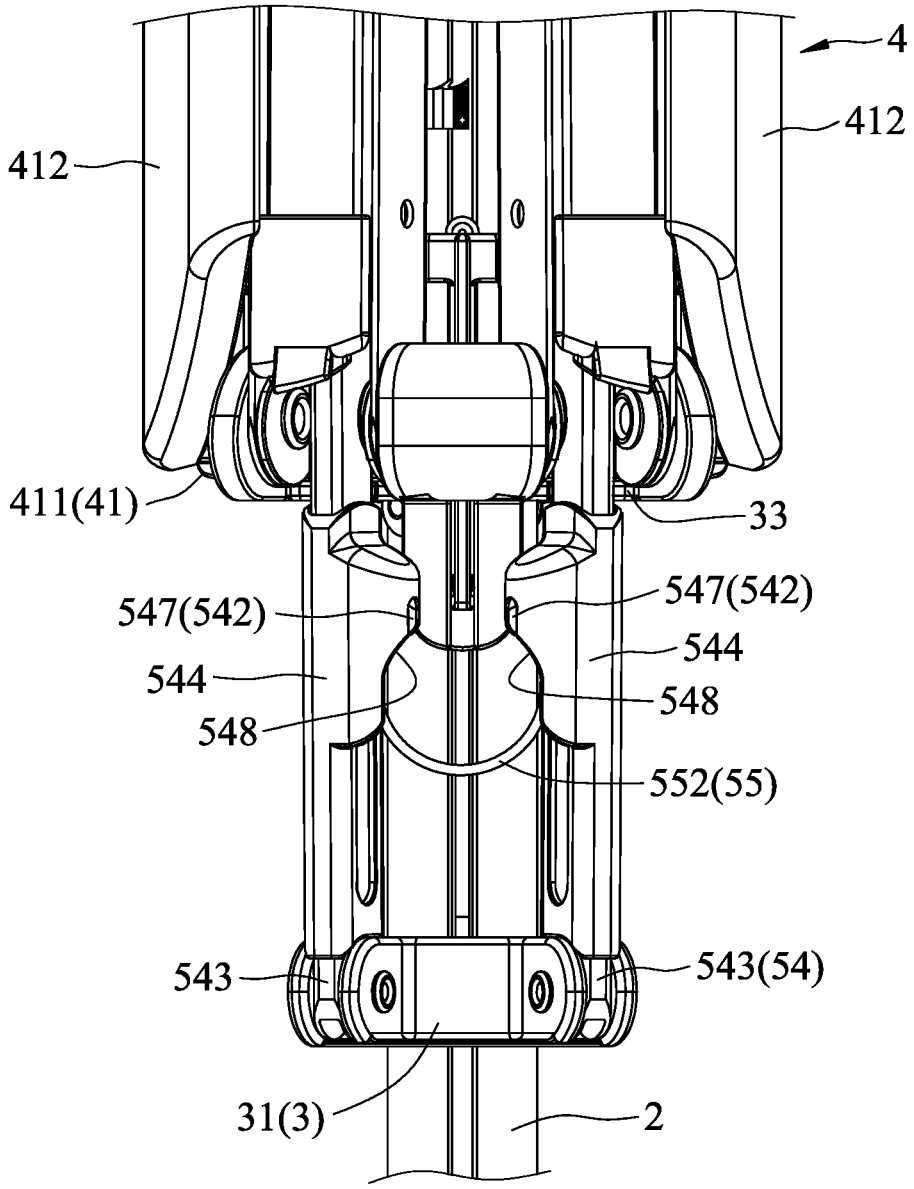
FIG. 8 is another schematic fragmentary perspective view illustrating the rope guiding device.
Figure 9:
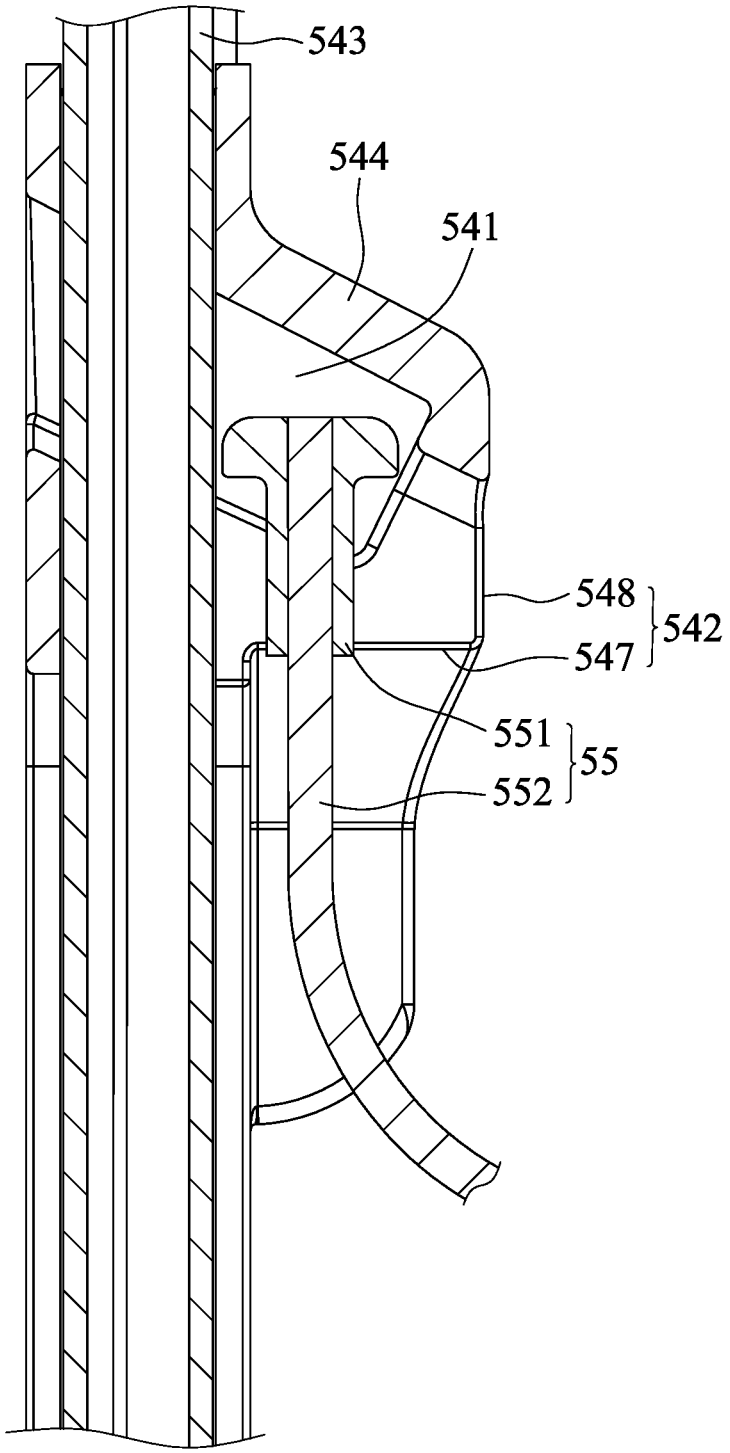
FIG. 9 is another schematic fragmentary sectional view illustrating the rope guiding device.

The walking stick chair of this disclosure is operable to convert between an unfolded state (see FIGS. 3, 4 and 6) and a folded state (see FIGS. 7 to 9). When the walking stick chair 1 is in the unfolded state, the second sliding seat 33 is positioned relative to the main stick 2 by a positioning screw (not shown). The first legs 51 cooperatively form an angle therebetween. The second legs 52 are away from the main stick 2 and cooperatively support the main stick 2 inclinedly on a ground. One of the opposite ends of each of the first links 42 is away from the main stick 2 to support the corresponding one of the lateral plates 412 of the seat unit 4, so that the seat plate assembly 41 is unfolded and the main plate 411 and the lateral plates 412 are coplanar. At this time, the limiting rope 55 connected between the limiting link assemblies 54 extends through the first groove sections 547 of the guiding grooves 542 of the limiting link assemblies 54, and is stretched for preventing increase of the angle formed between the first legs 51, so as to prevent excessive deformation or fracture at the junction of the first legs 51 and the second sliding seat 33.

When the walking stick chair is converted from the unfolded state to the folded state, the first and second sliding seats 32, 33 are moved away from each other such that the first and second links 42, 43 drive the seat plate assembly 41 to be folded, and that each of the link members 53 drives the corresponding first and second legs 51, 52 and the corresponding limiting link assembly 54 to be folded. During the conversion of the walking stick chair from the unfolded state to the folded state, the limiting link assemblies 54 also move toward each other.

When the walking stick chair is in the folded state, each of the first legs 51 and the corresponding second leg 52 are mutually folded and close to the main stick 2, and the link members 53 and the limiting link assemblies 54 are close to the main stick 2. The first and second links 42, 43 of the seat unit 4 are close to the main stick, and the seat plate assembly 41 is folded such that the main plate 411 and the lateral plates 412 cooperatively form a U-shaped structure to extend around the main stick 2.

During the movement of the limiting link assemblies 54 toward each other, the limiting link assemblies 54 move the head pieces 551 of the limiting rope 55 toward each other so as to deform the rope body 552. During the deformation of the rope body 552, the opposite end portions of the rope body 552 respectively move along the guiding grooves 542 of the limiting link assemblies 54 toward the second groove sections 548 to respectively rotate the head pieces 551 relative to the limiting link assemblies 54, so as to prevent the opposite end portions from bending relative to the corresponding head pieces 551 to thereby prevent fracture of the limiting rope 55 and maintain the structural strength of the limiting rope 55. When the walking stick chair is converted from the folded state to the unfolded state, the limiting link assemblies 54 respectively move the opposite end portions of the rope body 552 along the guiding grooves 542 from the second groove sections 548 to the first groove sections 547 by virtue of the head pieces 551, so that the limiting rope 55 is switched from a bent state (see FIG. 8) to a stretched state (see FIG. 4).

The advantages of the walking stick chair of this disclosure are as follows:

1. By virtue of the cooperation of the limiting link assemblies 54 and the limiting rope 55 for limiting the angle formed between the first legs 51 when a user sits on the unfolded walking stick chair, once the user is relatively heavy or the ground is slippery, the junction of the first legs 51 and the second sliding seat 33 and the junction of the base seat 31 and the limiting links 543 of the limiting link assemblies 54 are prevented from excessive deformation or fracture resulted from the horizontal components of the force of gravity of the user.

2. During the movement of the limiting link assemblies 54 toward each other, the limiting link assemblies 54 move the head pieces 551 of the limiting rope 55 toward each other so as to deform the rope body 552. During the deformation of the rope body 552, the opposite end portions of the rope body 552 respectively move along the guiding grooves 542 of the limiting link assemblies 54 to respectively rotate the head pieces 551 relative to the limiting link assemblies 54. By such, the opposite end portions of the rope body 552 are respectively prevented from bending relative to the corresponding head pieces 551 to thereby prevent fracture of the limiting rope 55 and maintain the structural strength of the limiting rope 55. When the walking stick chair is in the folded state, the limiting rope 55 is configured to be U-shaped, and is received between the limiting link assemblies 54 so as to be prevented from interfering with other components of the walking stick chair.

3. By virtue of the retaining spaces 51 of the limiting link assemblies 54 for installation of the head pieces 551 of the limiting rope 55, there is no need to drill the limiting link assemblies 54 for mounting a costly pivoting structure to interconnect the limiting link assemblies 54 and the limiting rope 55. Therefore, the rope guiding device of this disclosure is relatively low-cost and safe.

Figure 10:
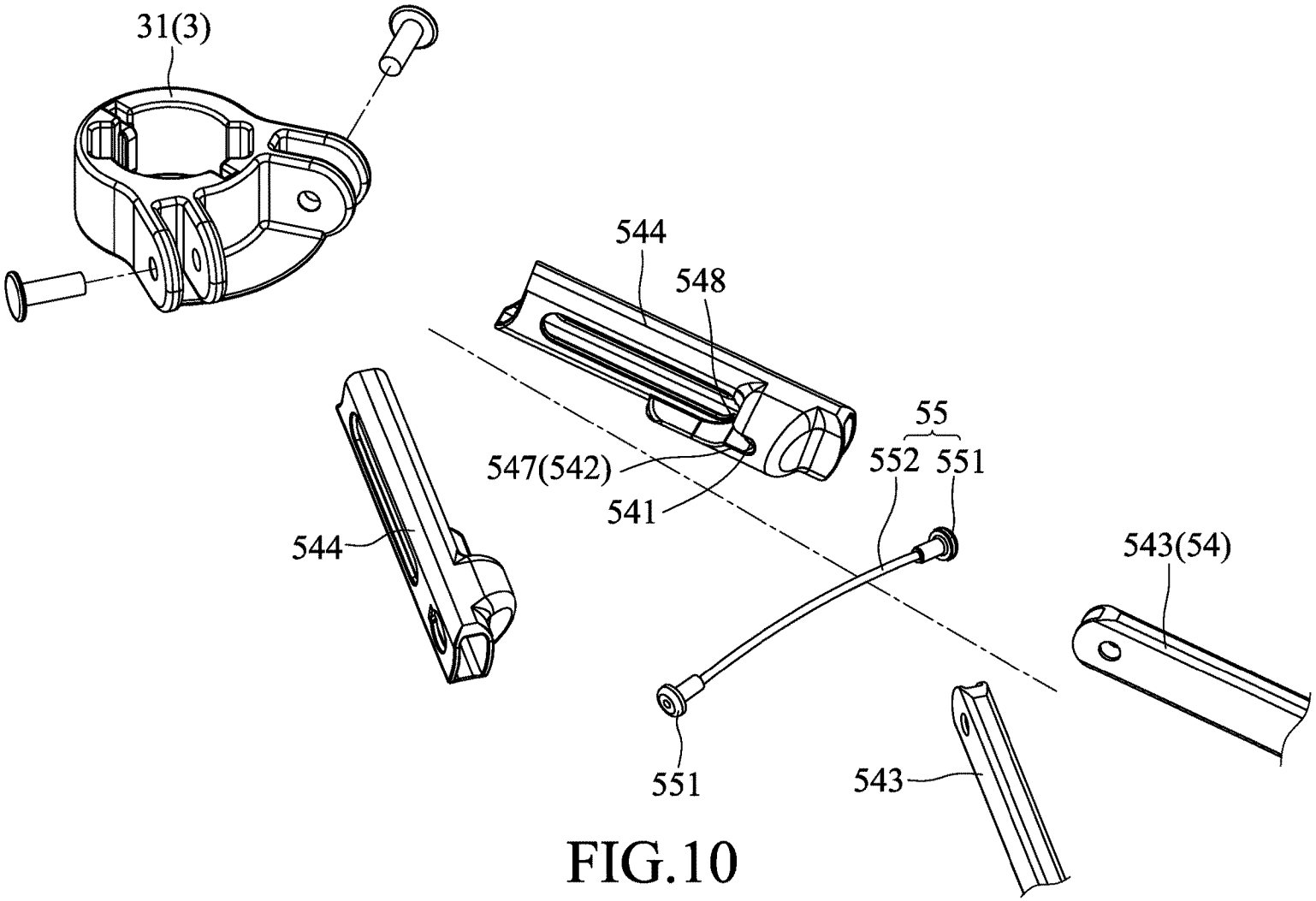
FIG. 10 is a fragmentary exploded perspective view illustrating a rope guiding device of a second embodiment of the walking stick chair according to the disclosure.
Figure 11:
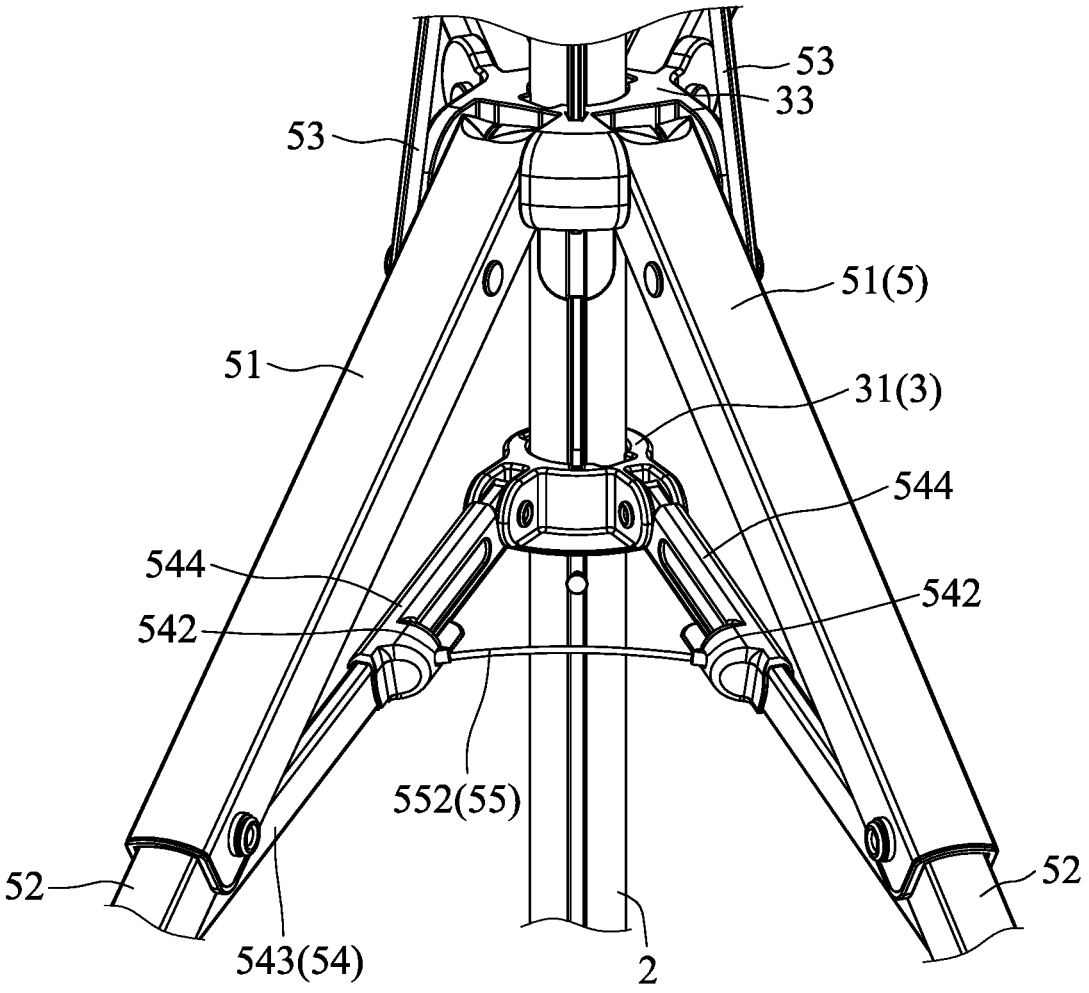
FIG. 11 is a schematic fragmentary perspective view illustrating the rope guiding device.

Referring to FIGS. 10 and 11, the second embodiment of the walking stick chair according to the disclosure is similar to the first embodiment. In the second embodiment, the second coupling structure 546 of the mounting seat 544 of each of the limiting link assemblies 54 is omitted, so that each of the mounting seats 544 is movable along the corresponding limiting link 543. By such, when the walking stick chair is in the folded state, the mounting seats 544 can be moved to adjust the center of gravity of the whole walking stick chair. When the walking stick chair is converted from the folded state to the unfolded state, the mounting seats 544 respectively move along the limiting links 543 to abut against the base seat 31, and cooperate with the limiting rope 55 for limiting the angle formed between the first legs 51. In one embodiment, the mounting seat 544 of each of the limiting link assemblies 54 may be movably sleeved on the corresponding limiting link 543.

Figure 12:
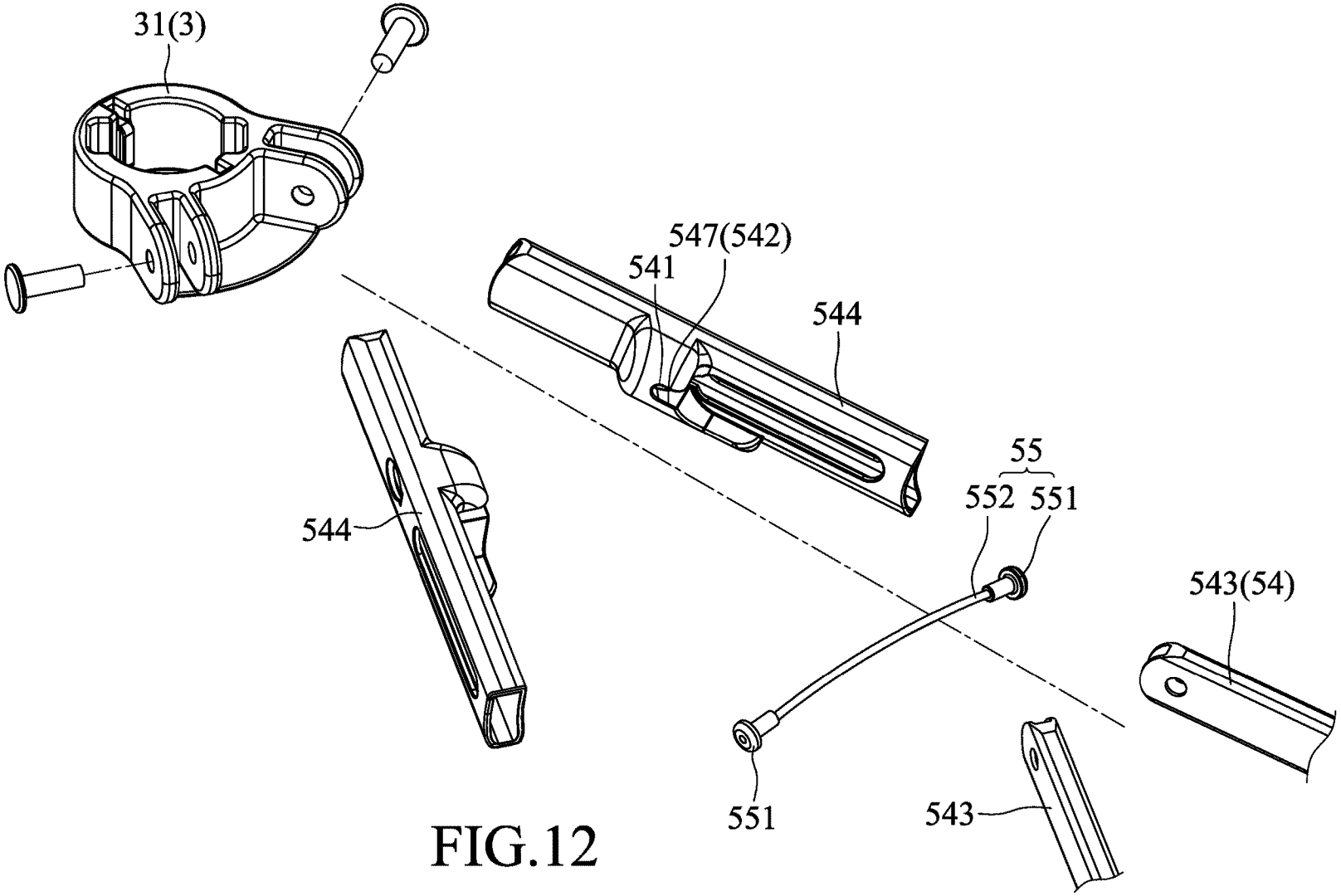
FIG. 12 is a fragmentary exploded perspective view illustrating a rope guiding device of a variation of the second embodiment.

Referring to FIG. 12, in a variation of the second embodiment, each of the mounting seats 544 may be mounted to the corresponding limiting link 543 in such a manner that the second groove section 548 of the guiding grooves 542 of each of the limiting link assemblies 54 opens away from the base seat 31.

It should be noted that, the configuration of the walking stick chair of this disclosure is not limited to the abovementioned embodiments. For example, the limiting link assemblies 54 may respectively substitute for the first legs 51 of the first embodiment (see FIG. 3), and the limiting rope 55 is connected between the limiting link assemblies 54 for limiting an angle formed between the limiting link assemblies 54 when the walking stick chair is in the unfolded state.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A rope guiding device comprising:

a base seat;

two limiting link assemblies, each of said limiting link assemblies being movably connected to said base seat, and having a retaining space therein, and a guiding groove that is formed in an outer surface thereof and that is in spatial communication with said retaining space; and a limiting rope including two head pieces that are respectively and movably retained in said retaining spaces of said limiting link assemblies, and a rope body that has two opposite end portions respectively extending through said guiding grooves of said limiting link assemblies and respectively connected to said head pieces, each of said head pieces having a width greater than the width of each of said guiding grooves and the width of said rope body;

wherein, when said limiting link assemblies are moved toward each other, said limiting link assemblies move said head pieces of said limiting rope toward each other so as to deform said rope body, during the deformation of said rope body, said end portions of said rope body respectively moving along said guiding grooves of said limiting link assemblies to respectively rotate said head pieces relative to said limiting link assemblies.

2. The rope guiding device as claimed in claim 1, wherein said guiding groove of each of said limiting link assemblies has a first groove section and a second groove section, said first groove sections of said guiding grooves of said limiting link assemblies opening toward each other.

3. The rope guiding device as claimed in claim 2, wherein each of said limiting link assemblies further includes a limiting link that has an end pivotally connected to said base seat, and a mounting seat that is mounted to said limiting link, said mounting seat of each of said limiting link assemblies having an outer surface formed with said guiding groove of said limiting link assembly, said mounting seat and said limiting link of each of said limiting link assemblies cooperatively defining said retaining space of said limiting link assembly.

4. The rope guiding device as claimed in claim 3, wherein, for each of said limiting link assemblies, said mounting seat is sleeved on and movable along said limiting link.

5. The rope guiding device as claimed in claim 3, wherein said limiting link of each of said limiting link assemblies has a first coupling structure, said mounting seat of each of said limiting link assemblies having a second coupling structure that is proximate to said base seat, for each of said limiting link assemblies, said mounting seat being fixedly mounted to said limiting link by virtue of said first and second coupling structures.

6. A walking stick chair comprising:

a main stick;

an interlink unit including a base seat that is disposed on said main stick;

a seat unit disposed on said main stick, and including a seat plate assembly that is movable relative to said main stick; and a leg unit including two limiting link assemblies and a limiting rope, each of said limiting link assemblies being pivotally connected to said base seat, and having a retaining space therein, and a guiding groove that is formed in an outer surface thereof and that is in spatial communication with said retaining space, said limiting rope including two headpieces that are respectively and movably retained in said retaining spaces of said limiting link assemblies, and a rope body that has two opposite end portions respectively extending through said guiding grooves of said limiting link assemblies and respectively connected to said head pieces, each of said head pieces having a width greater than the width of each of said guiding grooves and the width of said rope body;

wherein, said walking stick chair is operable to convert between an unfolded state and a folded state, when said walking stick chair is in the unfolded state, an end of said seat plate assembly being away from said main stick, said limiting link assemblies cooperatively forming an angle therebetween, and said limiting rope being stretched for limiting the angle formed between said limiting link assemblies, when said walking stick chair is converted from the unfolded state toward the folded state, said end of said seat plate assembly moving toward said main stick, and said limiting link assemblies pivoting toward said main stick and moving toward each other; and wherein, during the movement of said limiting link assemblies toward each other, said limiting link assemblies move said head pieces of said limiting rope toward each other so as to deform said rope body, during the deformation of said rope body, said end portions of said rope body respectively moving along said guiding grooves of said limiting link assemblies to respectively rotate said head pieces relative to said limiting link assemblies.

7. The walking stick chair as claimed in claim 6, wherein said guiding groove of each of said limiting link assemblies has a first groove section and a second groove section, said first groove sections of said guiding grooves of said limiting link assemblies opening toward each other.

8. The walking stick chair as claimed in claim 7, wherein said main stick has a handle end and a foot end opposite to said handle end, said base seat being sleeved on and movable along said main stick, said interlink unit further including a first sliding seat that is sleeved on and movable along said main stick and that is disposed at one side of said base seat opposite to said foot end of said main stick, and a second sliding seat that is sleeved on and movable along said main stick and that is disposed between said first sliding seat and said base seat, said seat plate assembly being pivotally connected to said first sliding seat, said leg unit further including two first legs each of which is pivotally connected to said second sliding seat, two second legs each of which is pivotally connected to a respective one of said first legs, and two link members each of which has two opposite ends respectively and pivotally connected to said first sliding seat and a respective one of said first legs, each of said limiting link assemblies having two opposite ends respectively and pivotally connected to said base seat and a respective one of said second legs, when said walking stick chair is in the unfolded state, said first legs cooperatively forming an angle therebetween, said second legs being away from said main stick and cooperatively supporting said main stick inclinedly on a ground, said limiting rope cooperating with said limiting link assemblies for limiting the angle formed between said first legs, when said walking stick chair is converted from the unfolded state to the folded state, said first and second sliding seats being moved away from each other such that each of said link members drives said corresponding first and second legs and said corresponding limiting link assembly to be folded, when said walking stick chair is in the folded state, each of said first legs and said corresponding second leg being mutually folded and close to said main stick, and said link members and said limiting link assemblies being close to said main stick.

9. The walking stick chair as claimed in claim 8, wherein each of said limiting link assemblies further includes a limiting link that has two opposite ends respectively and pivotally connected to said base seat and the corresponding one of said second legs, and a mounting seat that is mounted to said limiting link and that is proximate to said base seat, said mounting seat of each of said limiting link assemblies having an outer surface formed with said guiding groove of said limiting link assembly, said mounting seat and said limiting link of each of said limiting link assemblies cooperatively defining said retaining space of said limiting link assembly.

10. The walking stick chair as claimed in claim 9, wherein, for each of said limiting link assemblies, said mounting seat is sleeved on and movable along said limiting link.

11. The walking stick chair as claimed in claim 9, wherein said limiting link of each of said limiting link assemblies has a first coupling structure, said mounting seat of each of said limiting link assemblies having a second coupling structure that is proximate to said base seat, for each of said limiting link assemblies, said mounting seat being fixedly mounted to said limiting link by virtue of said first and second coupling structures.

* * * * *